US009355558B2

(12) United States Patent
Jain et al.

(10) Patent No.: US 9,355,558 B2
(45) Date of Patent: May 31, 2016

(54) HIGH BANDWIDTH CONFIGURABLE SERIAL LINK

(71) Applicant: Marvell World Trade Ltd., St. Michael (BB)

(72) Inventors: Kapil Jain, Santa Clara, CA (US); Sriharsha Annadore, San Jose, CA (US)

(73) Assignee: Marvell World Trade Ltd., St. Michael (BB)

( * ) Notice: Subject to any disclaimer, the term of this patent is extended or adjusted under 35 U.S.C. 154(b) by 255 days.

(21) Appl. No.: 14/053,111

(22) Filed: Oct. 14, 2013

(65) Prior Publication Data

US 2014/0105415 A1 Apr. 17, 2014

Related U.S. Application Data

(60) Provisional application No. 61/714,582, filed on Oct. 16, 2012.

(51) Int. Cl.
*G08C 19/00* (2006.01)

(52) U.S. Cl.
CPC ..... *G08C 19/00* (2013.01)

(58) Field of Classification Search
None
See application file for complete search history.

(56) References Cited

U.S. PATENT DOCUMENTS

2003/0033417 A1* 2/2003 Zou ..... G06F 3/023 709/230
2011/0103404 A1* 5/2011 Bafra ..... H04L 1/0084 370/476
2011/0274156 A1* 11/2011 Mighani ..... H04N 21/2381 375/240.02

* cited by examiner

*Primary Examiner* — Paul Huber

(57) ABSTRACT

Aspects of the disclosure provide an audio circuit that includes a clock circuit, a transmitting circuit, an audio data preparation circuit and a controller. The controller is configured to provide control signals to configure the transmitting circuit and the audio data preparation circuit according to one of a plurality of link protocol. The clock circuit is configured to provide a clock signal for bit transmission. The transmitting circuit is configured to transmit a bit in response to a transition edge of the clock signal according to the link protocol. The audio data preparation circuit is configured to insert audio data into a bit stream and provide the bit stream to the transmitting circuit according to the link protocol.

16 Claims, 18 Drawing Sheets

400

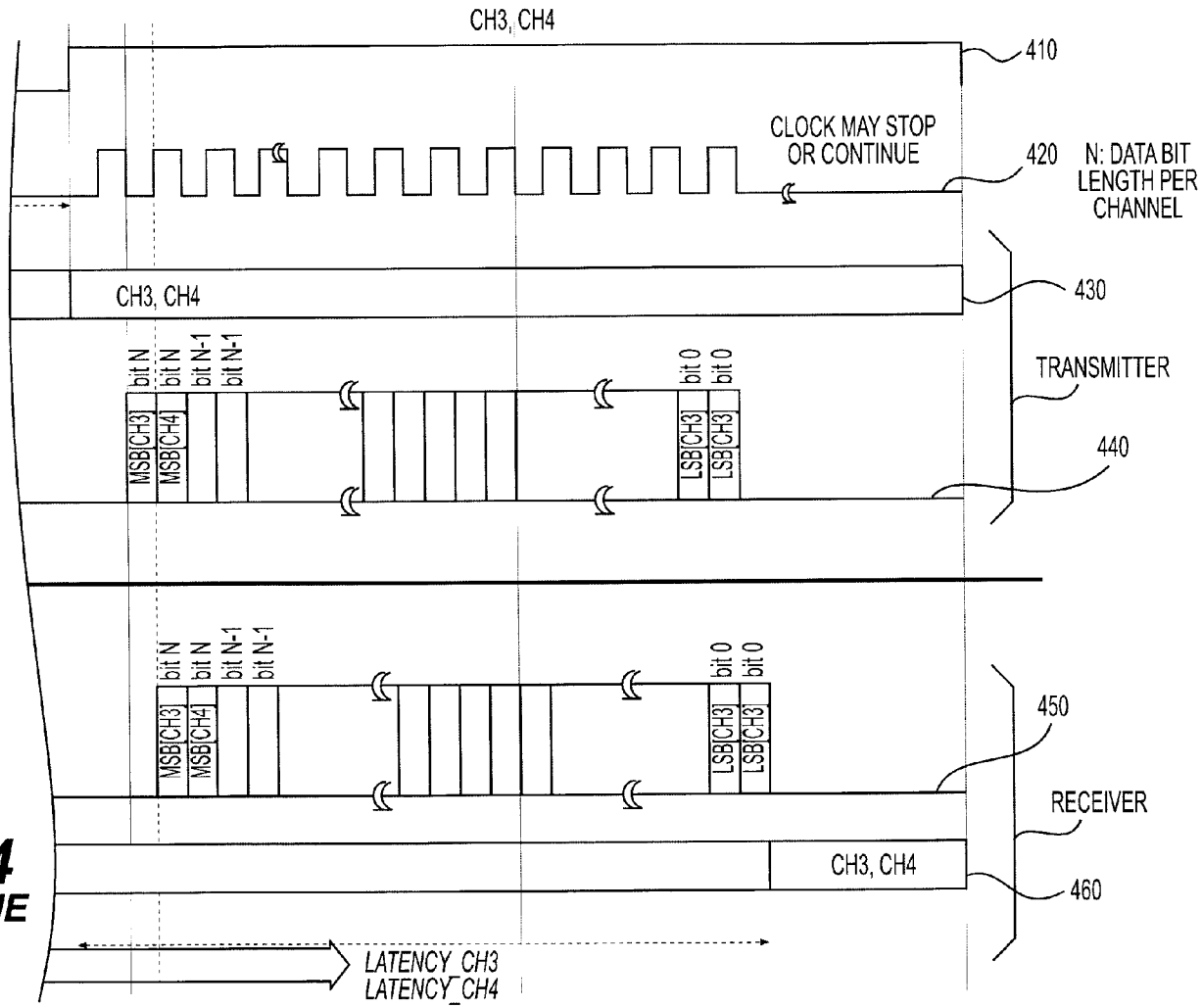
FIG. 4 CONTINUE

CONTINUE

CONTINUE

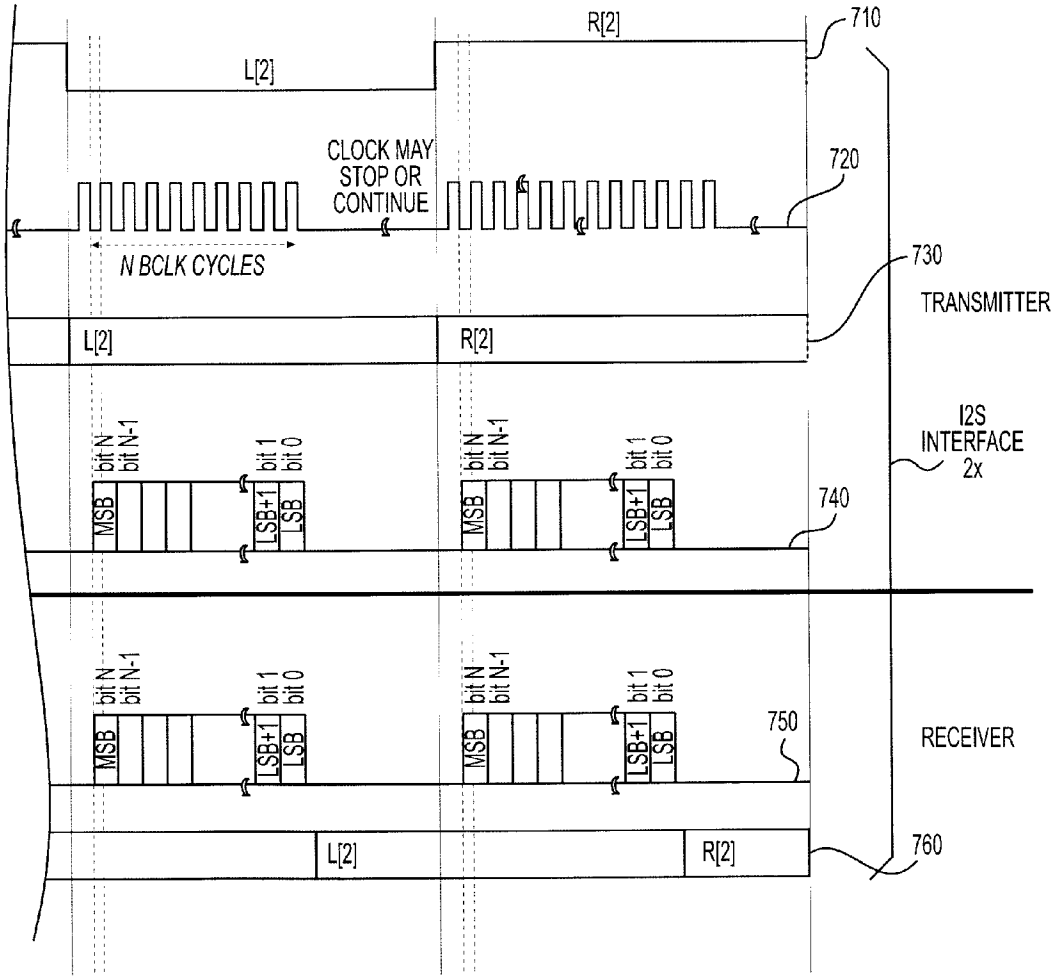
FIG. 7 CONTINUE

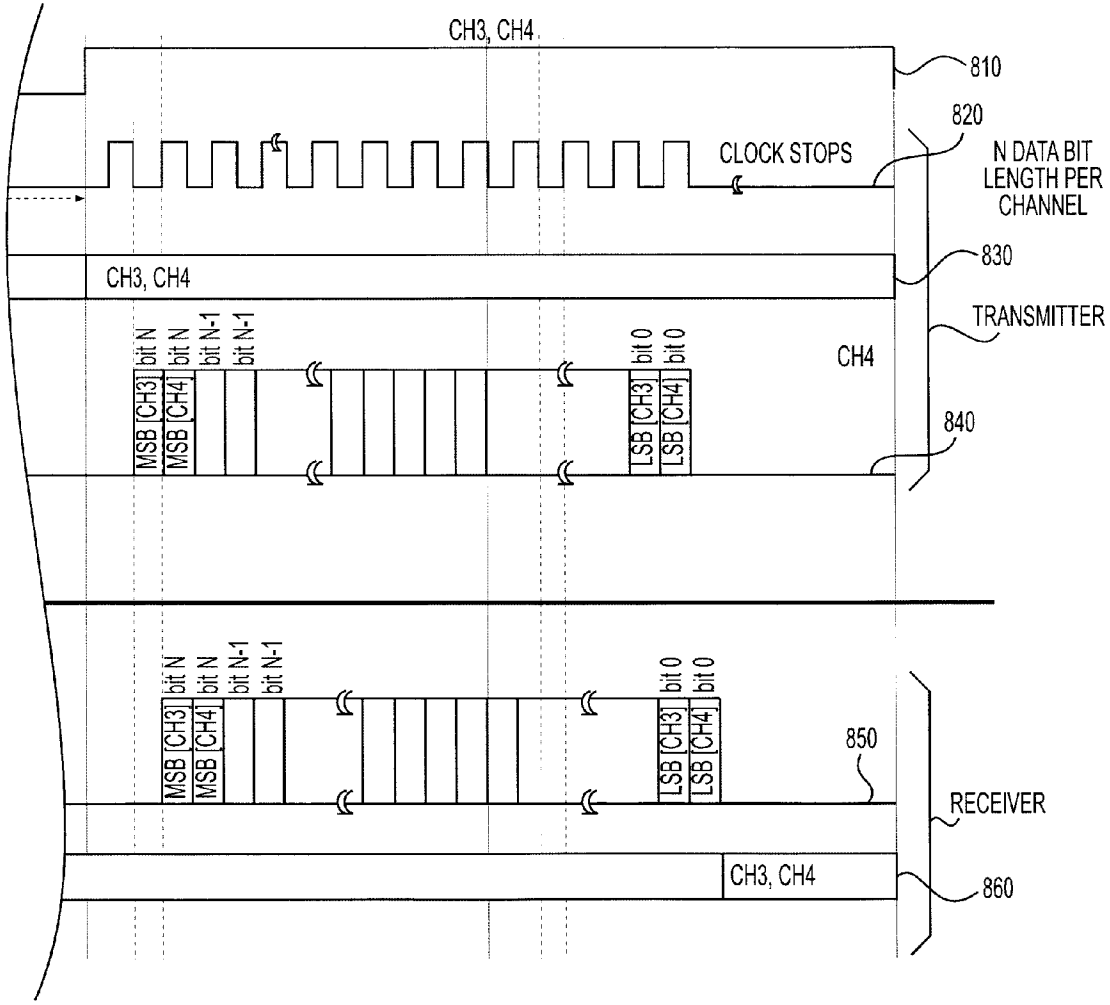
FIG. 8 CONTINUE

CONTINUE

CONTINUE

HIGH BANDWIDTH CONFIGURABLE SERIAL LINK

INCORPORATION BY REFERENCE

This present disclosure claims the benefit of U.S. Provisional Application No. 61/714,582, "HIGH BANDWIDTH CONFIGURABLE SERIAL LINK" filed on Oct. 16, 2012, which is incorporated herein by reference in its entirety.

BACKGROUND

A system, such as a TV system, a computer system, and the like can include a plurality of audio processing components, such as an analog-to-digital converter, a digital-to-analog converter, a digital signal processor and the like. Audio signals processed by one component are transmitted system, a media system, a computer system, and the like that perform audio signal processing. to another component for further processing.

SUMMARY

Aspects of the disclosure provide an audio circuit that includes a clock circuit, a transmitting circuit, an audio data preparation circuit and a controller. The controller is configured to provide control signals to configure the transmitting circuit and the audio data preparation circuit according to one of a plurality of link protocol. The clock circuit is configured to provide a clock signal for bit transmission. The transmitting circuit is configured to transmit a bit in response to a transition edge of the clock signal according to the link protocol. The audio data preparation circuit is configured to insert audio data into a bit stream and provide the bit stream to the transmitting circuit according to the link protocol.

Aspects of the disclosure provide a method for audio data transmission. The method includes configuring an audio data transmission interface according to a link protocol, inserting audio data into a bit stream according to the link protocol and transmitting the bit stream in response to transitions of a clock signal according to the link protocol.

Aspects of the disclosure provide another audio circuit that includes a clock circuit, a receiving circuit, an audio data extraction circuit, and a controller. The controller is configured to provide control signals to configure the receiving circuit and the audio data extraction circuit according to one of a plurality of link protocols. The clock circuit is configured to provide a clock signal for receiving a bit stream. The receiving circuit is configured to sample an input in response to transitions of the clock signal to receive the bit stream according to the link protocol. The audio data extraction circuit is configured to extract audio data from the bit stream according to the link protocol.

Aspects of the disclosure provide a method for receiving audio data. The method includes configuring an audio data receiver interface according to a link protocol, sampling an input in response to transitions of the clock signal to receive a bit stream according to the link protocol and extracting audio data from the bit stream according to the link protocol.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

Figure 1:
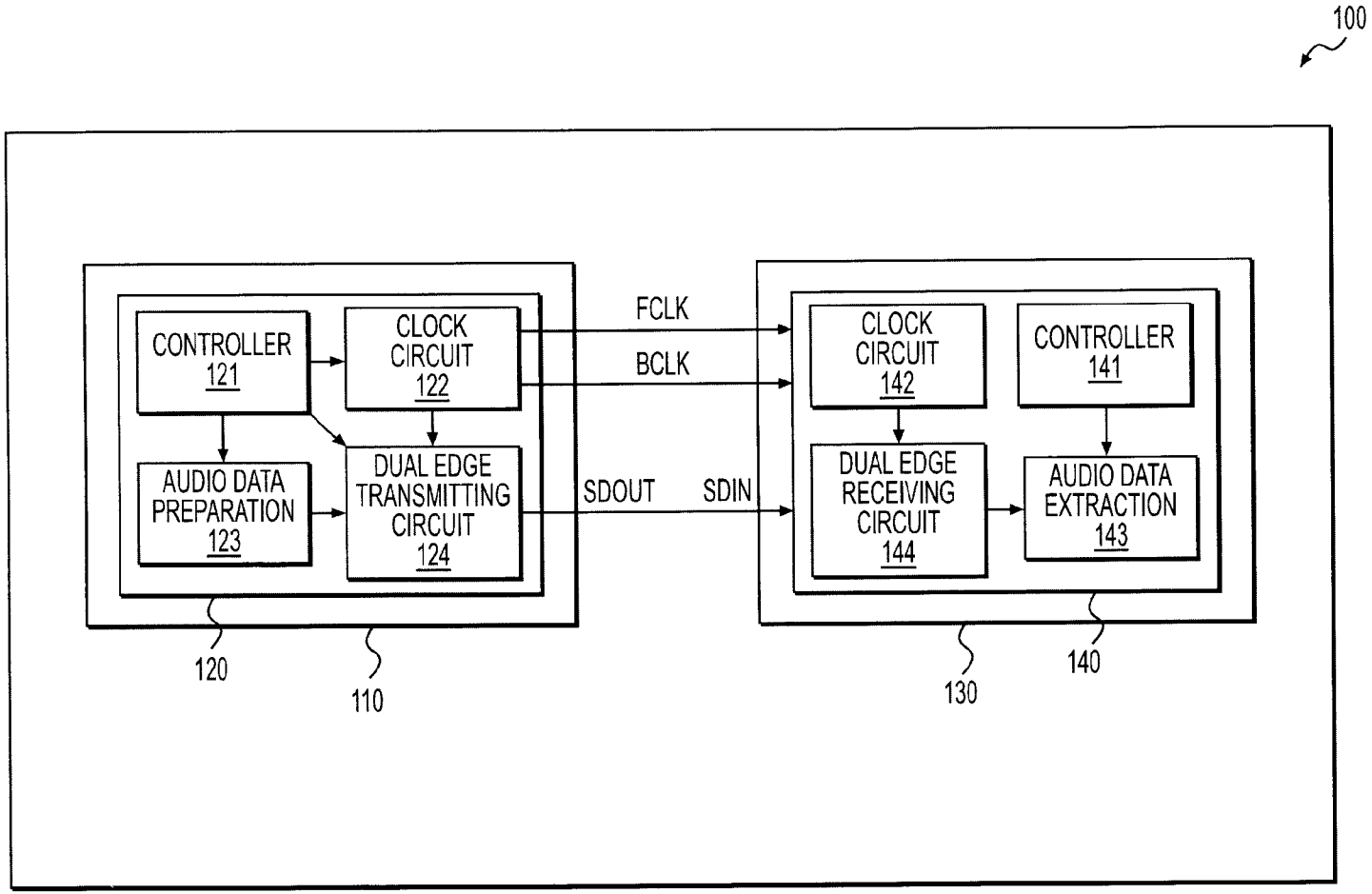
FIG. 1 shows a block diagram of an audio system example 100 according to an embodiment of the disclosure.

FIG. 1 shows a block diagram of an audio system example 100 according to an embodiment of the disclosure. The audio system 100 includes a plurality of audio processing circuits, such as a first circuit 110, a second circuit 130, and the like for audio signal processing. The audio processing circuits include interfaces to enable communication between the circuits. According to an aspect of the disclosure, the interfaces are configurable, and can be configured to achieve different merits, such as high bandwidth, low power, backward compatible, and the like, in various scenarios.

The audio system 100 can be any suitable system, such as a TV system, a music The audio processing circuits can include any suitable processing circuits, such as an analog-to-digital converter (ADC), a digital-to-analog converter (DAC), a digital signal processor, and the like that to process audio signals from different aspects. In an example, the first circuit 110 is a first integrated circuit (IC) chip having a digital signal processor (not shown). The digital signal processor is configured to process digital audio signals using digital processing techniques. The second circuit 130 is a second IC chip having a digital-to-analog converter (not shown). The digital-to-analog converter is configured to convert digital audio signals into analog audio signals.

In the FIG. 1 example, the first circuit 110 includes a first interface 120, and the second circuit 130 includes a second interface 140. The first interface 120 and the second interface 140 are coupled together into a serial link to transfer audio data between the first circuit 110 and the second circuit 130. The serial link includes a first conductive coupling for a frame clock (FCLK), a second conductive coupling for a bit clock (BCLK), and a third conductive coupling for serial data transmitting and receiving (SDOUT for the transmitting side and SDIN for the receiving side). In an example, a conductive coupling includes metal lines for signal transmission. The first interface 120 and the second interface 140 can be configured to achieve different merits in various scenarios.

Specifically, in an embodiment, the first interface 120 includes a controller 121, a clock circuit 122, an audio data preparation circuit 123, and a dual edge transmitting circuit 124 coupled together as shown in FIG. 1. The controller 121 provides control signals to the clock circuit 122, the audio data preparation circuit 123 and the dual edge transmitting circuit 124 to configure these circuits according to one of a plurality of link protocols.

In the FIG. 1 example, the clock circuit 122 is configured to provide clock signals to enable the audio data transfer between the first circuit 110 and the second circuit 130. In an example, the clock circuit 122 generates the frame clock and the bit clock, and provides the frame clock and the bit clock to the circuits in the first circuit 110. Further, the frame clock and the bit clock are provided to the second circuit 130. In an example, the frame clock has a relatively low frequency, and is used as word select, frame select, and the like. The bit clock has a relatively high frequency, and is used for bit transmission.

The clock circuit 122 is configurable, and can be configured according to the control signals from the controller 121. In an example, the frequencies of the frame clock and the bit clock can be changed based on the control signals from the controller 121. In another example, the clock circuit 122 can be configured to generate the bit clock with transitions disabled for a time duration.

The audio data preparation circuit 123 is configured to arrange audio data into a bit stream for transmission according to the control signals from the controller 121. The audio data preparation circuit 123 can be configured to arrange the bit stream in various manners, such as data unit interleave manner, a bit interleave manner, and the like.

The dual edge transmitting circuit 124 is configured to output SDOUT as bit-by-bit in the bit stream out of the first circuit 110. The dual edge transmitting circuit 124 transmits based on the frame clock and the bit clock provided by the clock circuit 122. In an embodiment, the dual edge transmitting circuit 124 is able to transmit a bit in response to a rising edge of the bit clock and transmit another bit in response to a falling edge of the bit clock. The falling edge can be immediate next to the rising edge.

The dual edge transmitting circuit 124 is configurable and can be configured according to the control signals from the controller 121. In an example, the dual edge transmitting circuit 124 is configured to transmit bits in response to rising edges of the bit clock, but not falling edges. In another example, the dual edge transmitting circuit 124 is configured to transmit bits in response to falling edges of the bit clock, but not rising edges. In another example, the dual edge transmitting circuit 124 is configured to transmit bits in response to both rising edges and falling edges of the bit clock.

Further, in an embodiment, the second interface 140 includes a controller 141, a clock circuit 142, an audio data extraction circuit 143, and a dual edge receiving circuit 144 coupled together as shown in FIG. 1. The controller 141 provides control signals to the audio data extraction circuit 143 and the dual edge receiving circuit 144 to configure these circuits according to one of a plurality of link protocols.

In the FIG. 1 example, the clock circuit 142 is configured to receive the frame clock and the bit clock from the first circuit 110. Further, the clock circuit 142 provides the frame clock and the bit clock to other circuits, such as the dual edge receiving circuit 144, the audio data extraction circuit 143 and the like to assist the receiving of the audio data.

The dual edge receiving circuit 144 is configured to receive an input SDIN corresponding to a bit stream transmitted from the first circuit 110. The dual edge receiving circuit 144 samples the input based on the bit clock provided by the clock circuit 142, and determine bits in the bit stream. The dual edge receiving circuit 144 can sample the input in response to a rising edge of the bit clock and can sample the input in response to a falling edge of the bit clock.

The dual edge receiving circuit 144 is configurable and can be configured according to the control signals from the controller 141. In an example, the dual edge receiving circuit 144 is configured to sample the input in response to rising edges of the bit clock, but not falling edges. In another example, the dual edge receiving circuit 144 is configured to sample the input in response to falling edges of the bit clock, but not rising edges. In another example, the dual edge receiving circuit 144 is configured to sample the input in response to both rising edges and falling edges of the bit clock.

The audio data extraction circuit 143 is configured to extract audio data from the received bit stream according to the control signals from the controller 141.

According to an aspect of the disclosure, the controller 121 and the controller 141 respectively include registers storing values corresponding to a link protocol. The link protocol can be pre-set or can be determined during operation by a system controller (not shown) to achieve certain merit for a scenario.

During operation, in an example, according to stored values corresponding to the link protocol, the controller 121 provides control signals to the audio data preparation circuit 123, the clock circuit 122 and the dual edge transmission circuit 124 to configure these circuits; similarly, the controller 141 provides control signals to the dual edge receiving circuit 144 and the audio data extraction circuit 143 to configure these circuit according to the link protocol. Then, audio data is transmitted from the first interface 120 to the second interface 140 according to the link protocol.

In the FIG. 1 example, the first circuit 110 provides the frame clock and the bit clock to the second circuit 130. The first circuit 110, which is the audio data transmitter in the audio system 100, is referred to as a master, and the second circuit 130, which is the audio data receiver in the audio system 100 is referred to as a slave.

It is noted that the audio system 100 can be modified to use other master-slave configuration.

Figure 2:
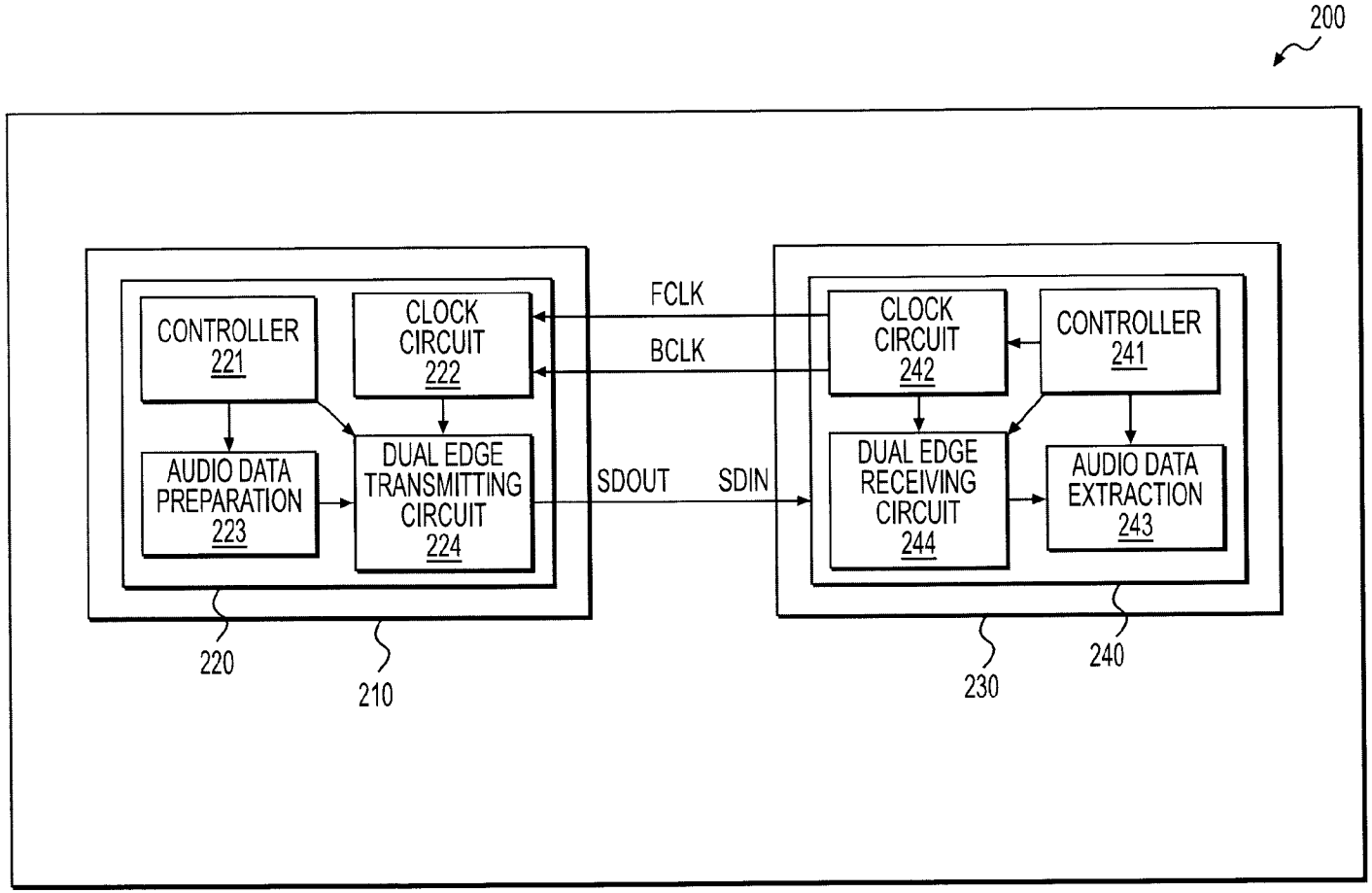
FIG. 2 shows a block diagram of another audio system example 200 according to an embodiment of the disclosure.

FIG. 2 shows a block diagram of another audio system 200 according to an embodiment of the disclosure. The audio system 200 operates similarly to the audio system 100 described above. The audio system 200 also utilizes certain components that are identical or equivalent to those used in the audio system 100; the description of these components has been provided above and will be omitted here for clarity purposes. However, the audio system 200 has a different master-slave configuration from the audio system 100.

Specifically, in the FIG. 2 example, the clock circuit 242 is configured to provide clock signals to enable the audio data transfer between the first circuit 210 and the second circuit 230. In an example, the clock circuit 242 generates the frame clock and the bit clock, and provides the frame clock and the bit clock to the circuits in the second circuit 230. Further, the frame clock and the bit clock are provided to the first circuit 110. The clock circuit 242 is configurable, and can be configured according to the control signals from the controller 241. In an example, the frequencies of the frame clock and the bit clock can be changed based on the control signals from the controller 241. In another example, the clock circuit 242 can be configured to generate the bit clock with transitions disabled for a time duration.

Then, the clock circuit 222 in the first circuit 210 is configured to receive the frame clock and the bit clock. Further, the clock circuit 222 provides the frame clock and the bit clock to other circuits, such as the dual edge transmitting circuit 224 to transmit the audio data.

In the FIG. 2 example, the second circuit 230, which is the audio data receiver in the audio system 200 is referred to as a master; and the first circuit 210, which is the audio data transmitter in the audio system 200, is referred to as a slave.

Figure 3:
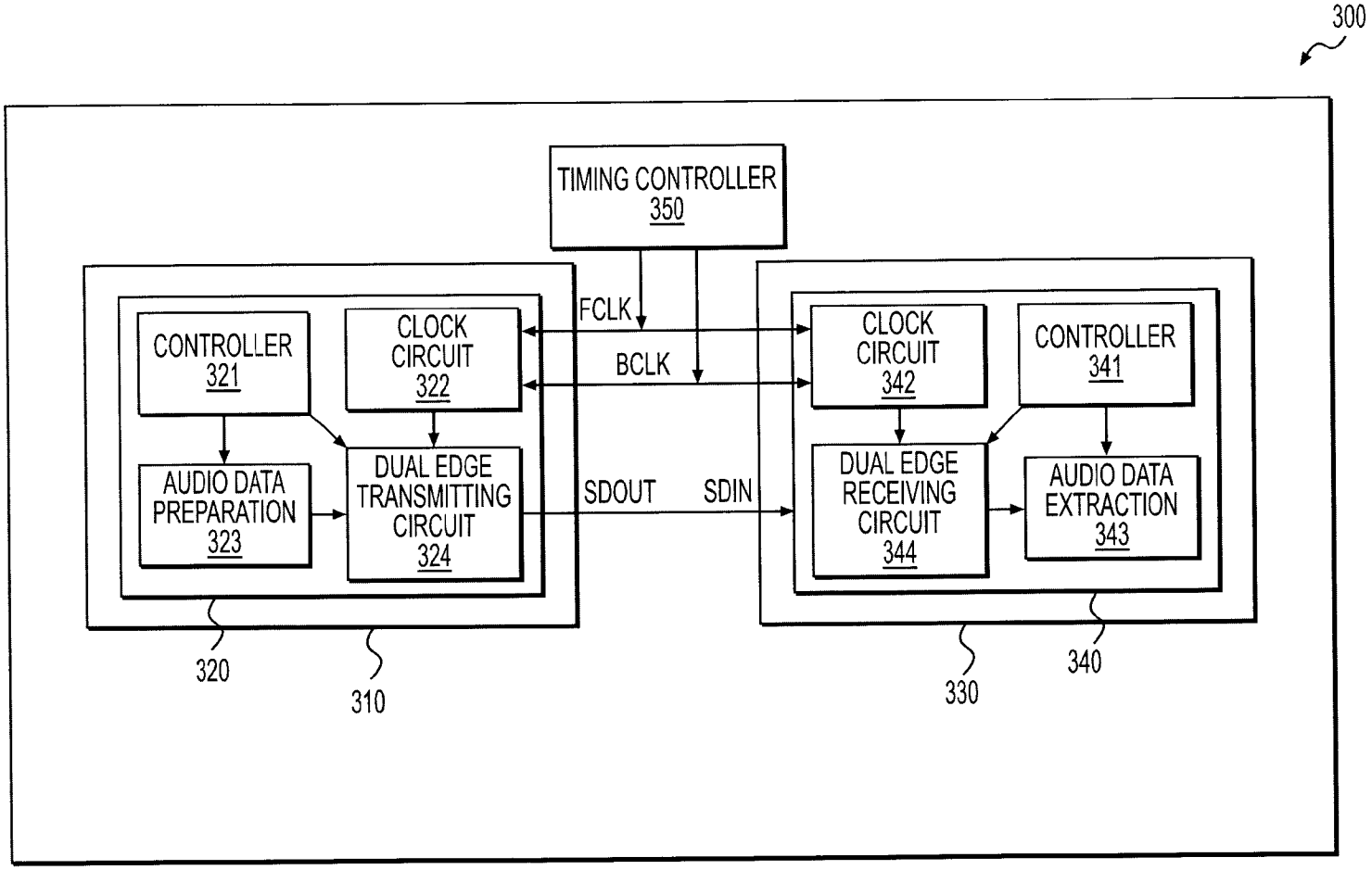
FIG. 3 shows a block diagram of another audio system example 300 according to an embodiment of the disclosure.

FIG. 3 shows a block diagram of another audio system 300 according to an embodiment of the disclosure. The audio system 300 operates similarly to the audio system 100 described above. The audio system 300 also utilizes certain components that are identical or equivalent to those used in the audio system 100; the description of these components has been provided above and will be omitted here for clarity purposes. However, the audio system 300 has a different master-slave configuration from the audio system 100 or the audio system 200.

Specifically, in the FIG. 3 example, the audio system 300 includes a timing controller 350 that is external to the first circuit 310 and the second circuit 330. The timing controller 350 is configured to provide clock signals to enable the audio data transfer between the first circuit 310 and the second circuit 330. In an example, the timing controller 350 generates the frame clock and the bit clock, and provides the frame clock and the bit clock to the first circuit 310 and the second circuit 330.

Then, the clock circuit 322 in the first circuit 310 is configured to receive the frame clock and the bit clock from the timing controller 350. Further, the clock circuit 322 provides the frame clock and the bit clock to other circuits, such as the dual edge transmitting circuit 324 to transmit a bit stream.

Further, the clock circuit 342 in the second circuit 330 is configured to receive the frame clock and the bit clock from the timing controller 350. Further, the clock circuit 342 provides the frame clock and the bit clock to other circuits, such as the dual edge receiving circuit 344 to receive the bit stream.

In the FIG. 3 example, the timing controller 350 is referred to as a master; and both the first circuit 310 and the second circuit 330 are referred to as slaves.

Figure 4:
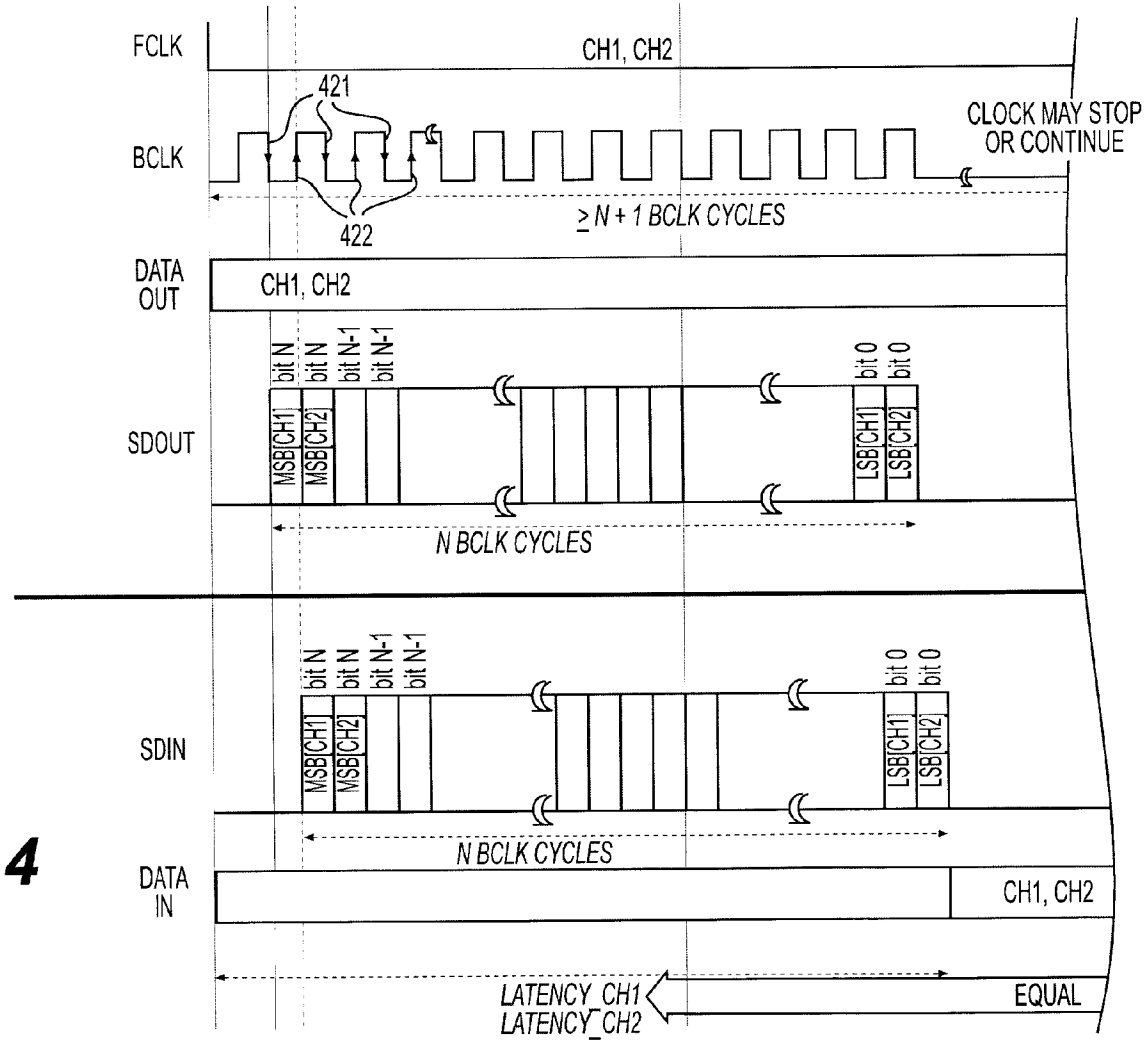
FIG. 4 shows a plot 400 of waveforms according to an embodiment of the disclosure.

FIG. 4 shows a plot 400 of waveforms according to an embodiment of the disclosure. In an example, the waveforms are for signals in an audio system, such as the audio systems 100, 200, 300, and the like, when the audio system is configured according to a link protocol. For ease and simplicity, the audio system 100 is used in the following description. The plot includes a first waveform 410 for the frame clock (FCLK), a second waveform 420 for the bit clock (BCLK), a third waveform 430 for audio data to be output from the transmitter, a fourth waveform 440 for the bit stream output SDOUT, a fifth waveform 450 for input SDIN to the receiver, a sixth waveform 460 for received audio data. The waveforms 430-440 are for signals at the transmitter of the audio system, and the waveforms 450-460 are for signals at the receiver of the audio system.

In the FIG. 4 example, the first circuit 110 (the transmitter side of the audio system 100) transmits four data units in one frame clock period. The four data units are respectively for each of four audio channels. In an example, each data unit is an audio sample having a bit length of N. N is a positive integer number, such as 16, 20, 24, 32 and the like and is programmable. Each half frame clock period includes more than N+1 bit clock cycles.

In the FIG. 4 example, the dual edge transmitting circuit 124 is configured to transmit bits in response to both rising edges and failing edges of the bit clock. When the frame clock has a relatively low voltage level (referred to as low), the audio data preparation circuit 123 arranges audio data of channel 1 and channel 2 into a bit stream for transmission. In this example, the audio data preparation circuit 123 interleaves bits from the audio data units of the channel 1 and channel 2 to form the bit stream. In an example, the bit stream starts from the most significant bit of channel 1 and ends with the least significant bit of channel 2. Thus, in the FIG. 4 example, the dual edge transmitting circuit 124 transmits bits of channel 1 in response to falling edges 421 of the bit clock and transmits bits of channel 2 in response to rising edges 422 of the bit clock when the frame clock is low.

Similarly, when the frame clock has a relatively high voltage level (referred to as high), the audio preparation circuit 123 arranges audio data of channel 3 and channel 4 into a bit stream for transmission. The dual edge transmitting circuit 124 then transmits interleaved bits from channel 3 and 4 in response to both falling edges and rising edges of the bit clock.

In the FIG. 4 example, when the half frame clock period is much larger than N+1 bit clock cycles, the bit clock can be stopped for a time period after the bit stream has been transmitted in order to save power. The bit clock can be restart when another bit stream is ready for transmission.

The second circuit 130 (the receiver of the audio system 100) receives four data units in one frame clock period. The four data units are respectively for the four channels. Specifically, the dual edge receiving circuit 144 samples the input SDIN at both rising edges and falling edges of the bit clock to receive a bit stream. In the FIG. 4 example, when the frame clock is low, the samples at the rising edges are bits of audio data for channel 1, and the samples at the falling edges are bits of audio data for channel 2. The audio data extraction circuit 143 then extracts the audio data for channel 1 and channel 2 from the bit stream.

In this example, because both rising edges and falling edges are used for transmitting and receiving, the audio data transmission has a higher bandwidth than a system that transmits at either rising edges or falling edging. Further, in the example, channel latency is about the same for channels 1-4.

Figure 5:
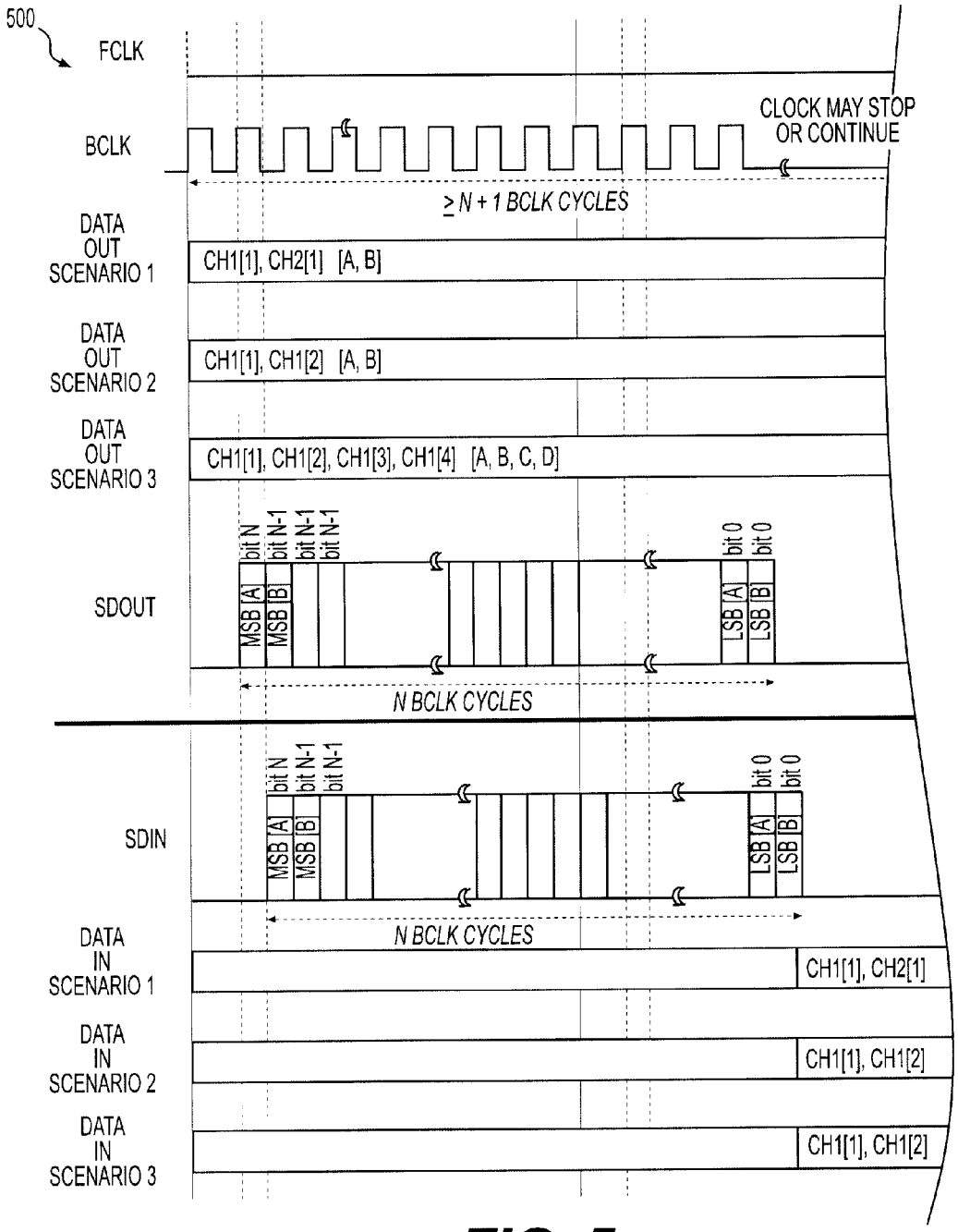
FIG. 5 shows a plot 450 of waveforms according to an embodiment of the disclosure.
Figure 5:
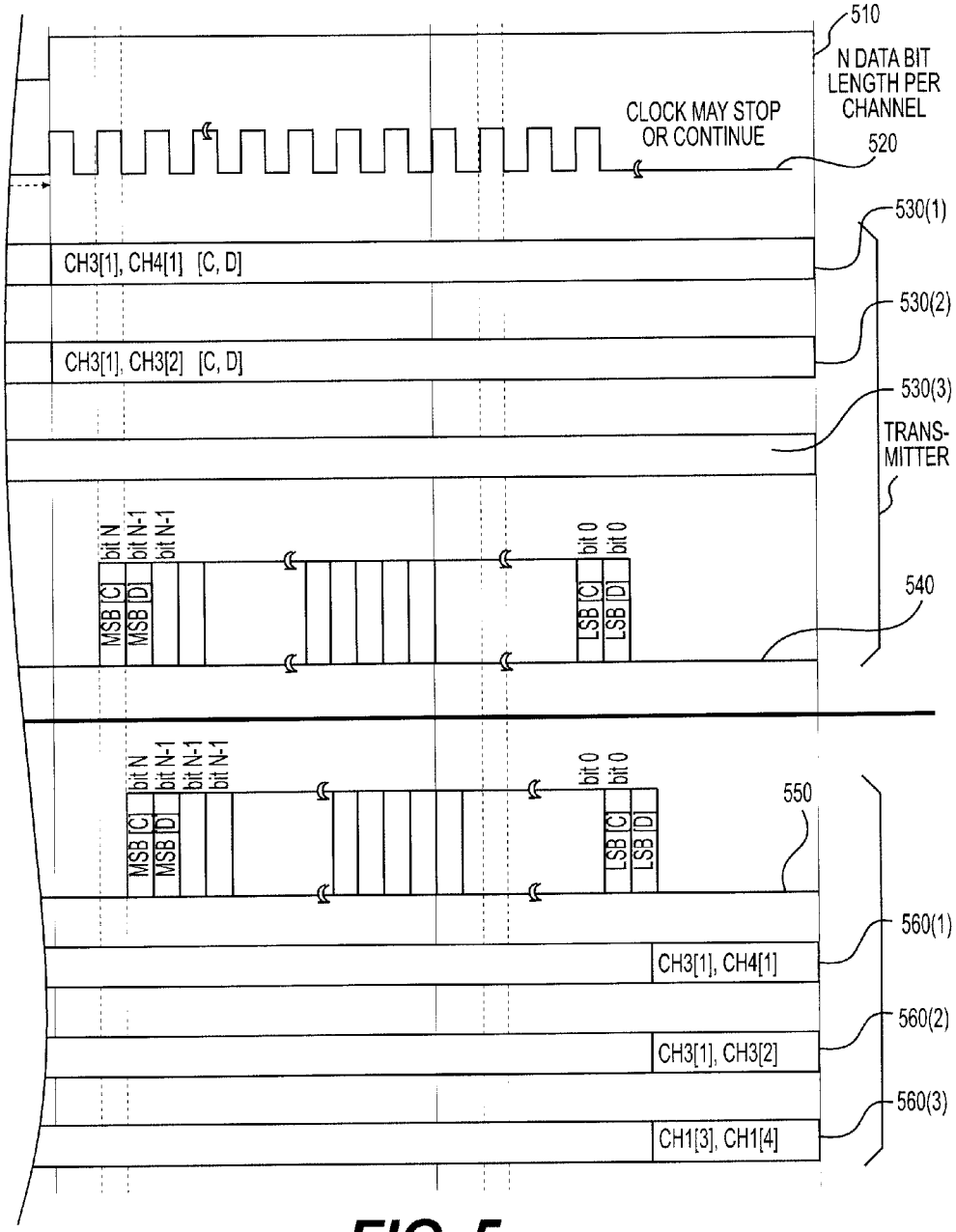

FIG. 5 shows a plot 500 of waveforms according to an embodiment of the disclosure. In an example, the waveforms are for signals in an audio system, such as the audio systems 100, 200, 300, and the like. For ease and simplicity, the audio system 100 is used in the following description. Some waveforms in FIG. 5 are similar or equivalent to the waveforms in FIG. 4; the description of these waveforms has been provided above and will be omitted here for clarity purposes.

In the FIG. 5 example, the plot 500 shows waveforms for three scenarios. In a first scenario, the audio system 100 is configured to have four channels (e.g. channels 1-4). In a second scenario, the audio system 100 is configured to have two channels (e.g., channels 1 and 3). In a third scenario, the audio system 100 is configured to have one channel (e.g., channel 1). The waveform 530(1) shows audio data for transmission for the first scenario, the waveform 530(2) shows audio data for transmission for the second scenario, and the waveform 530(3) shows audio data for transmission for the third scenario.

In the first scenario, the first circuit 110 transmits one data unit for each channel in one frame clock cycle as seen by the waveform 530(1), and the second circuit 130 receives one data unit for each channel in one frame clock cycle as seen by the waveform 560(1).

In the second scenario, the first circuit 110 transmits two data units for each channel in one frame clock cycle as seen by the waveform 530(2), and the second circuit 130 receives two data units for each channel in one frame clock cycle as seen by the waveform 560(2).

In the third scenario, the first circuit 110 transmits four data units for the single channel in one frame clock cycle as seen by the waveform 530(3), and the second circuit 130 receives four data units for the single channel in one frame clock cycle as seen by the waveform 560(3).

Figure 6:
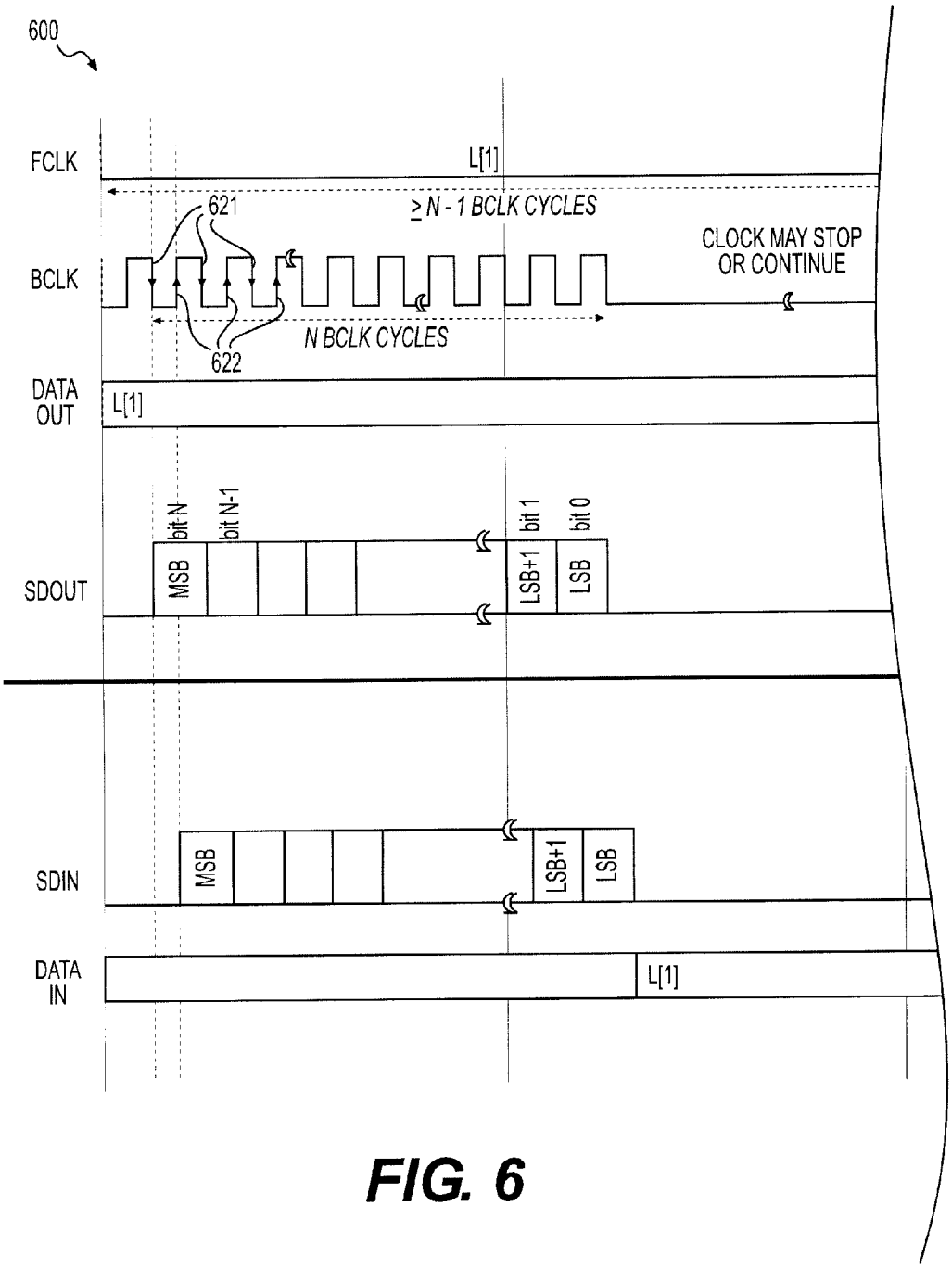
FIG. 6 shows a plot 600 of waveforms according to an embodiment of the disclosure.
Figure 6:
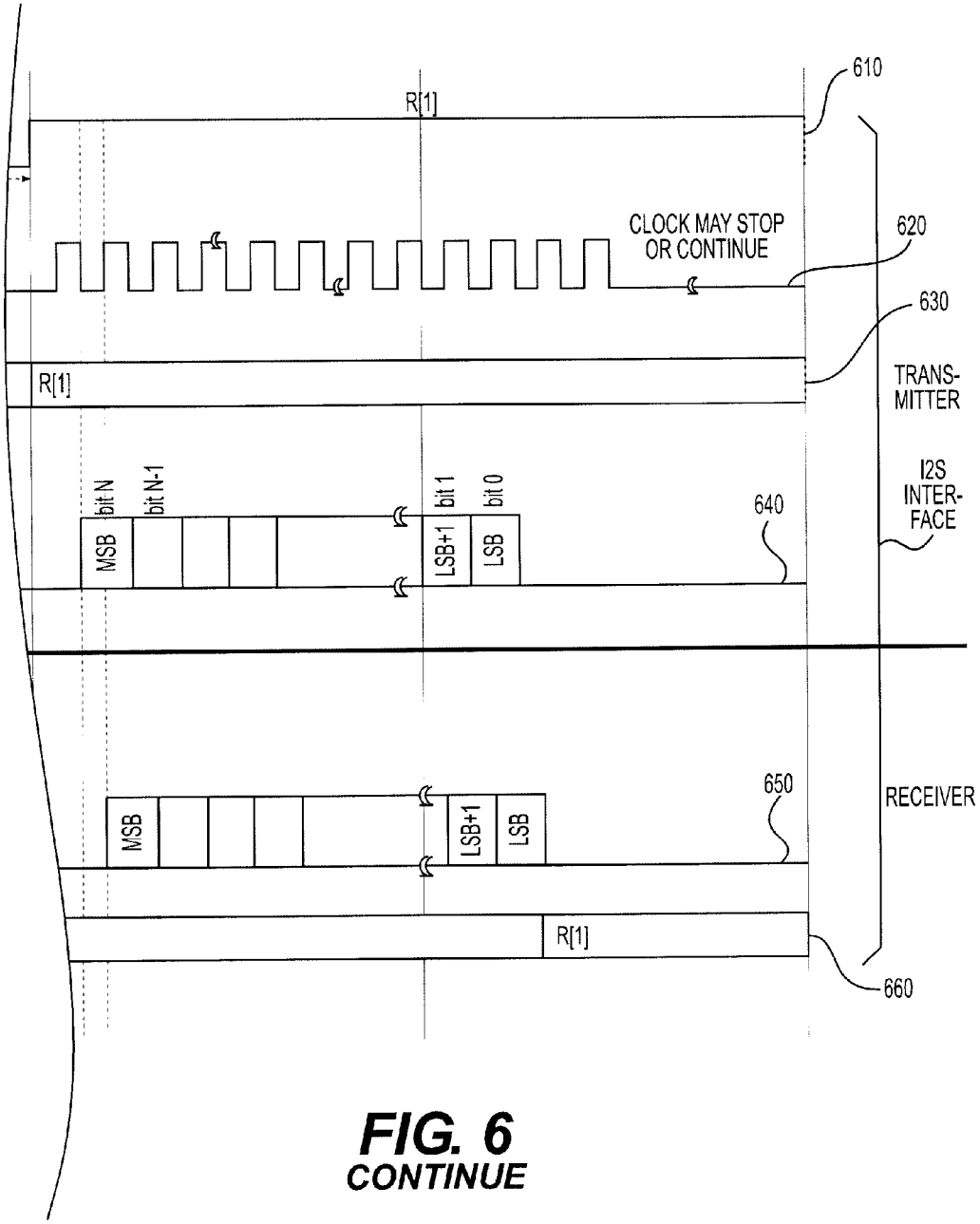

FIG. 6 shows a plot 600 of waveforms according to an embodiment of the disclosure. In an example, the waveforms are for signals in an audio system, such as the audio systems 100, 200, 300, and the like. For ease and simplicity, the audio system 100 is used in the following description. Some waveforms in FIG. 6 are similar or equivalent to the waveforms in FIGS. 4-5; the description of these waveforms has been provided above and will be omitted here for clarity purposes.

In the FIG. 6 example, the first interface 120 and the second interface 140 are configured according a standard inter-IC sound (I2S) link protocol. In the example, the audio system 100 is configured to have two channels, a left channel (L[1]) and a right channel (R[1]).

Further, the dual edge transmitting circuit 124 is configured to transmit bits in response to only falling edges of the bit clock. When the frame clock is low, the audio preparation circuit 123 arranges audio data of the left channel into a bit stream for transmission; and when frame clock is high, the audio preparation circuit 123 arranges audio data of the right channel into a bit stream for transmission.

The dual edge receiving circuit 144 is configured to sample the input SDIN in response to only rising edges of the bit clock. Thus, the second circuit 130 receives the audio data for the left channel when the frame clock is low, and receives the audio data for the right channel when the frame clock is high.

In an example, a tester is coupled to the audio system 100 to test the audio system 100. The tester has an I2S interface. The interfaces of the circuits in the audio system 100 are then configured to be backward compatible with the tester.

Figure 7:
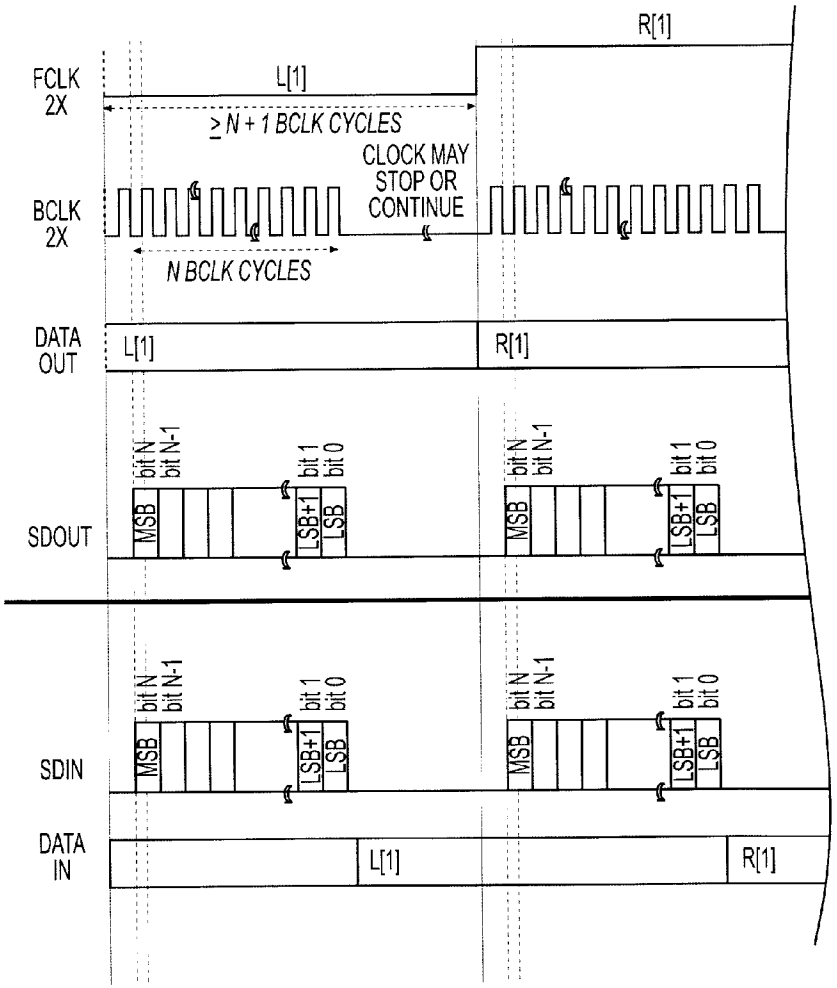
FIG. 7 shows a plot 700 of waveforms according to an embodiment of the disclosure.

FIG. 7 shows a plot 700 of waveforms according to an embodiment of the disclosure. In an example, the waveforms are for signals in an audio system, such as the audio systems 100, 200, 300, and the like. For ease and simplicity, the audio system 100 is used in the following description. Some waveforms in FIG. 7 are similar or equivalent to the waveforms in FIGS. 4-6; the description of these waveforms has been provided above and will be omitted here for clarity purposes.

In the FIG. 7 example, the first interface 120 and the second interface 140 are configured according a standard inter-IC sound (I2S) link protocol. In this example, the audio system 200 is configured to have four channels, a first left channel (L[1]), a first right channel (R[1]), a second left channel (L[2]), and a second right channel (R[2]).

Further, the dual edge transmitting circuit 124 is configured to transmit bits in response to only falling edges of the bit clock. The dual edge receiving circuit 144 is configured to sample the input SDIN in response to only rising edges of the bit clock.

In the FIG. 7 example, the audio system 100 is configured to double the frequencies of the frame clock and the bit clock. Thus, in two frame clock periods, the first circuit 110 transmits and the second circuit 130 receives four audio data units. The four audio data units are respectively for the four channels.

Figure 8:
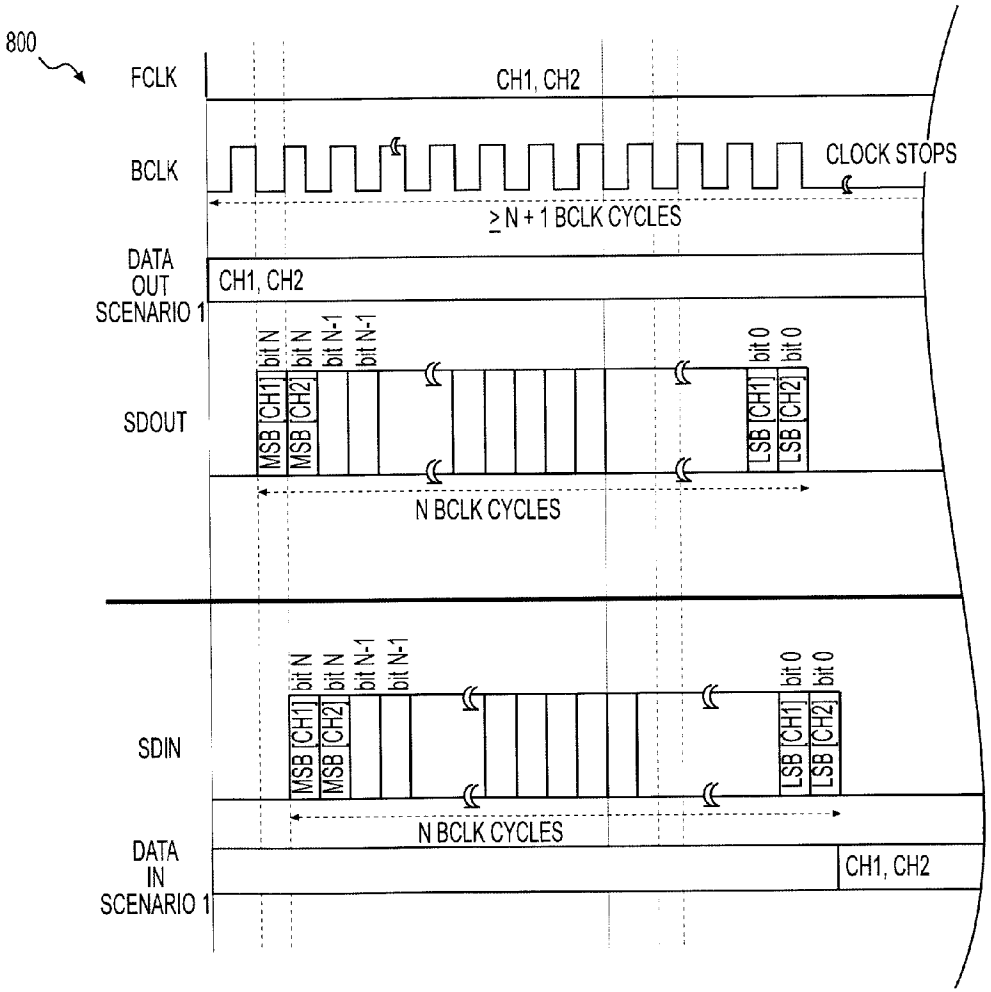
FIG. 8 shows a plot 800 of waveforms according to an embodiment of the disclosure.

FIG. 8 shows a plot 800 of waveforms according to an embodiment of the disclosure. In an example, the waveforms are for signals in an audio system, such as the audio systems 100, 200, 300, and the like. For ease and simplicity, the audio system 100 is used in the following description. Some waveforms in FIG. 8 are similar or equivalent to the waveforms in FIG. 4; the description of these waveforms has been provided above and will be omitted here for clarity purposes.

In the FIG. 8 example, in each half frame clock cycle, when the bit stream of audio data has been transmitted, the bit clock is disabled to stop transitions, and thus power is saved. The bit clock can be enabled after the next half frame clock cycle starts.

Figure 9:
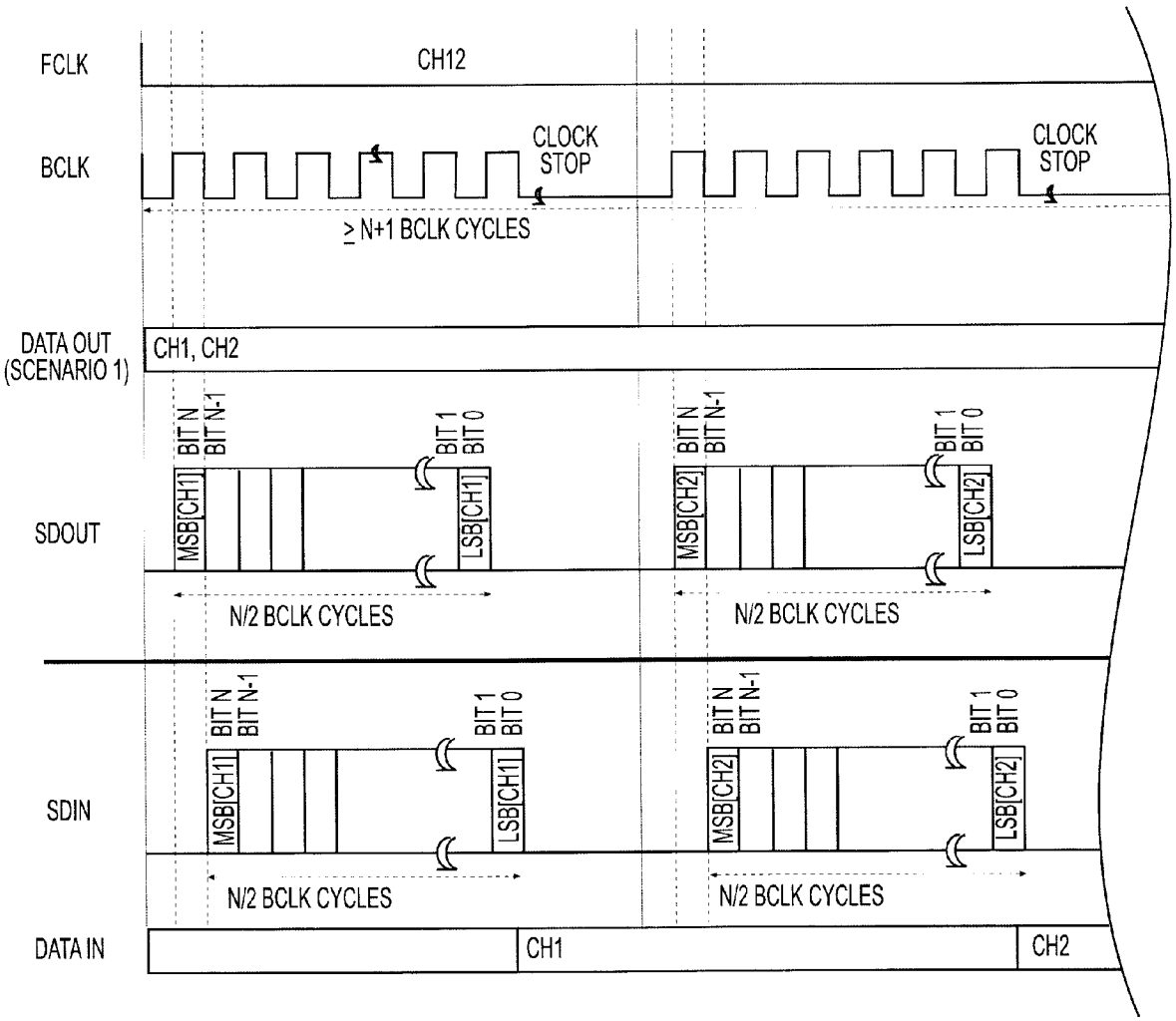
FIG. 9 shows a plot 900 of waveforms according to an embodiment of the disclosure.
Figure 9:
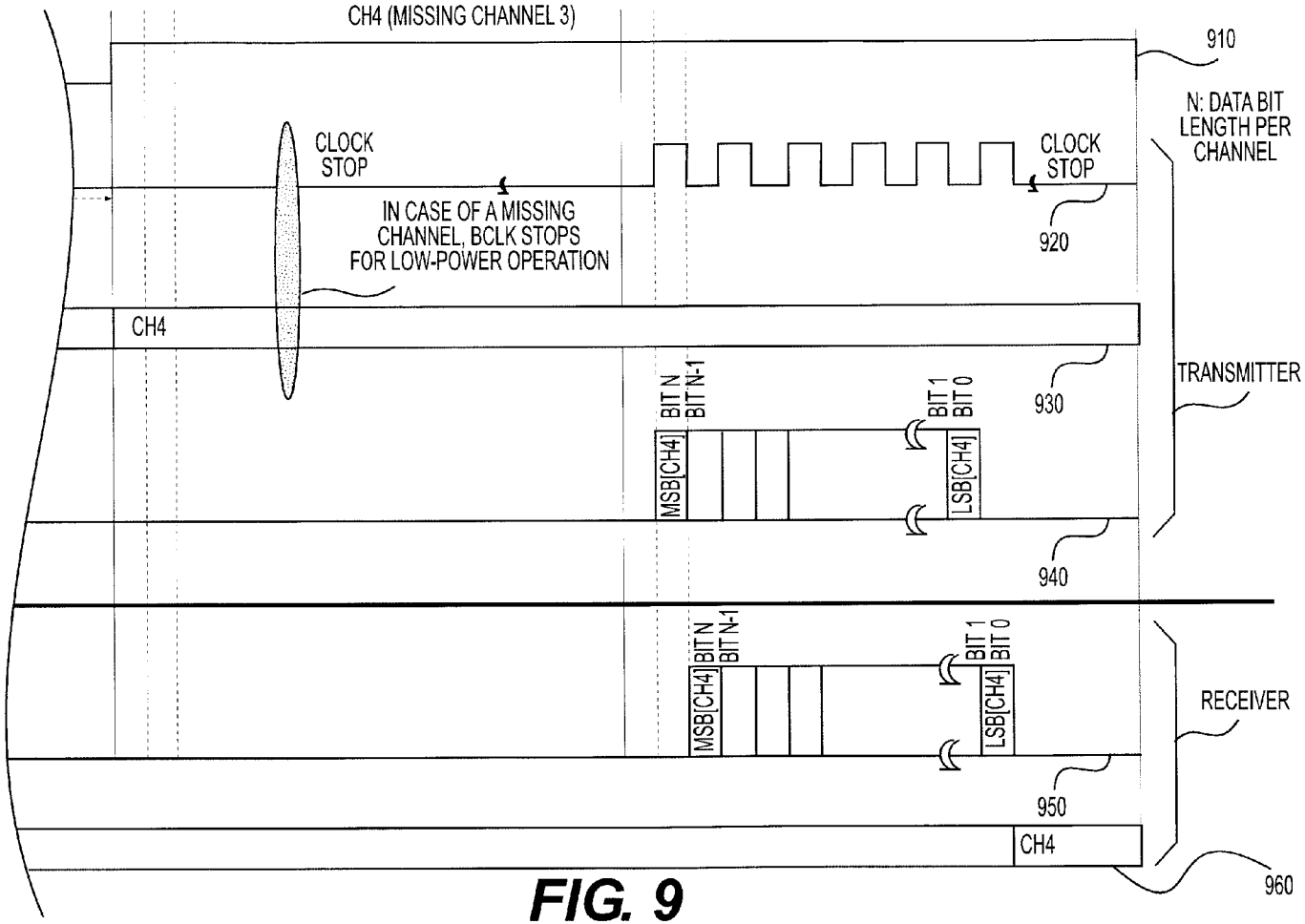

FIG. 9 shows a plot 900 of waveforms according to an embodiment of the disclosure. In an example, the waveforms are for signals in an audio system, such as the audio systems 100, 200, 300, and the like. For ease and simplicity, the audio system 100 is used in the following description. Some waveforms in FIG. 9 are similar or equivalent to the waveforms in FIGS. 4-8; the description of these waveforms has been provided above and will be omitted here for clarity purposes.

In the FIG. 9 example, the audio system 100 is configured to use three channels, for example channel 3 is missing. In the FIG. 9 example, the audio data preparation circuit 123 is configured not to interleave bits from different channels. When the frame clock is low, the audio data preparation circuit 123 provides a first bit stream corresponding to an audio data unit for channel 1, and a second bit stream corresponding to an audio data unit for channel 2 to the dual edge transmission circuit 124. When the frame clock is high, because channel 3 is missing, no bit stream for the channel 3 is provided. Further, the bit clock is disabled for a time period allotted for transmitting a bit stream for the channel 3 in order to save power.

Figure 10:
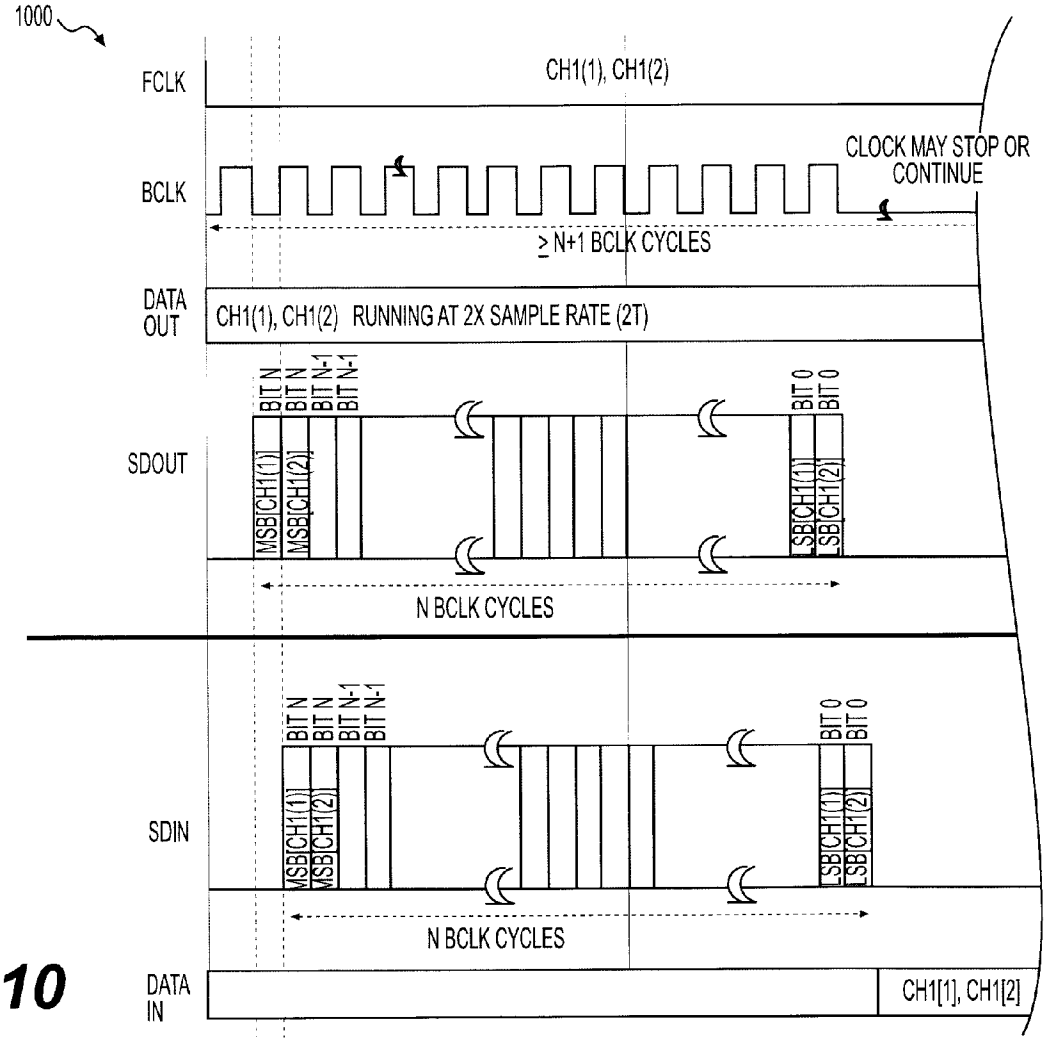
FIG. 10 shows a plot 1000 of waveforms according to an embodiment of the disclosure.
Figure 10:
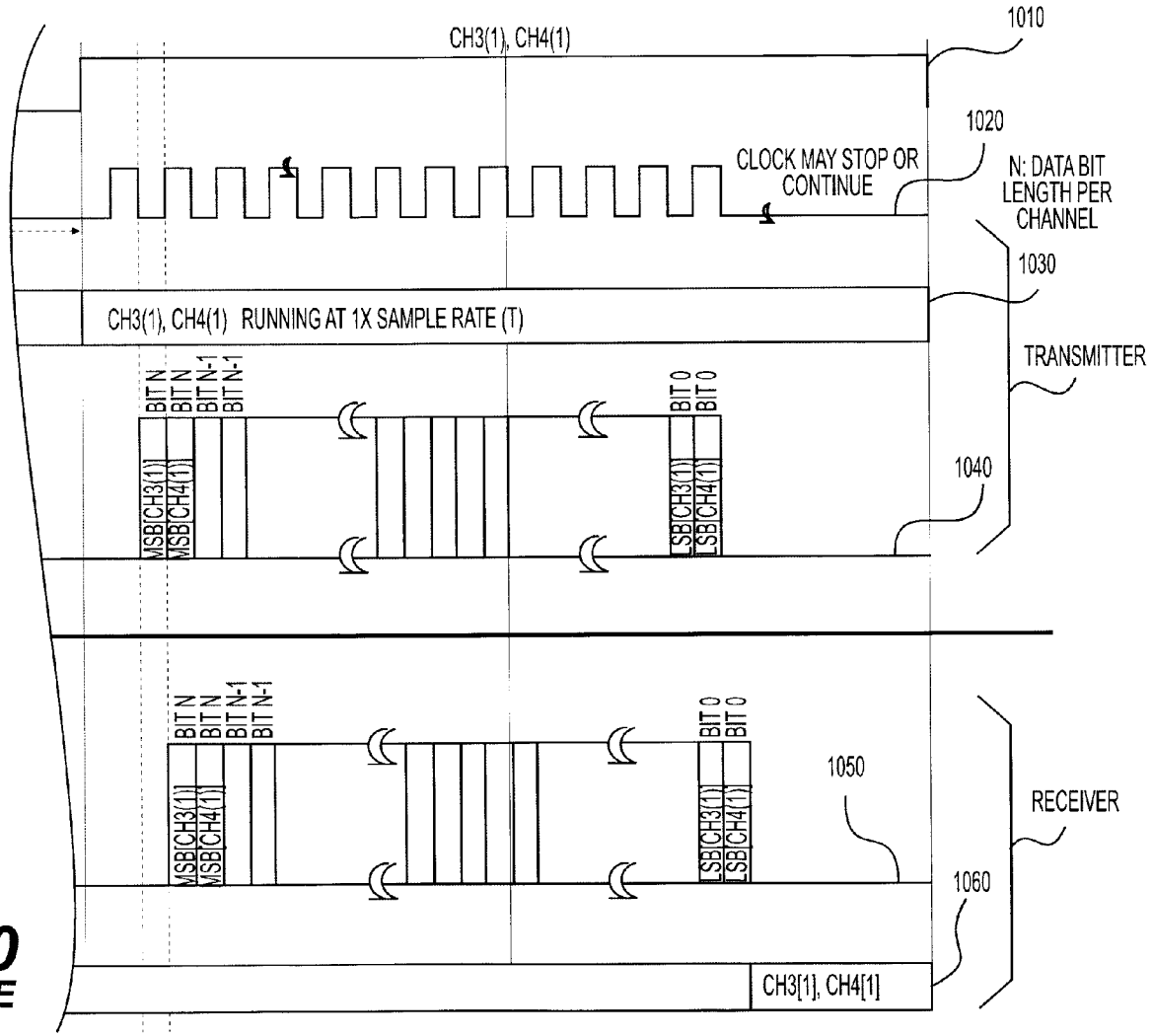

FIG. 10 shows a plot 1000 of waveforms according to an embodiment of the disclosure. In an example, the waveforms are for signals in an audio system, such as the audio systems 100, 200, 300, and the like. For ease and simplicity, the audio system 100 is used in the following description. Some waveforms in FIG. 10 are similar or equivalent to the waveforms in FIGS. 4-9; the description of these waveforms has been provided above and will be omitted here for clarity purposes.

In the FIG. 10 example, the audio system 100 is configured to use three channels, channel 1, channel 3 and channel 4. In the FIG. 10 example, sample rate for channel 1 is higher than channel 3 and channel 4. For example, the sample rate for channel 1 is doubled. When the frame clock is low, the audio data preparation circuit 123 arranges two audio data units from channel 1 into a bit stream. When the frame clock is high, the audio data preparation circuit 123 arranges one audio data unit from channel 3 and one audio data unit from channel 4 into a bit stream. The second circuit 130 then receives two audio data units for channel 1, one audio data unit for channel 3 and one audio data unit for channel 4 in each frame clock cycle.

Figure 11:
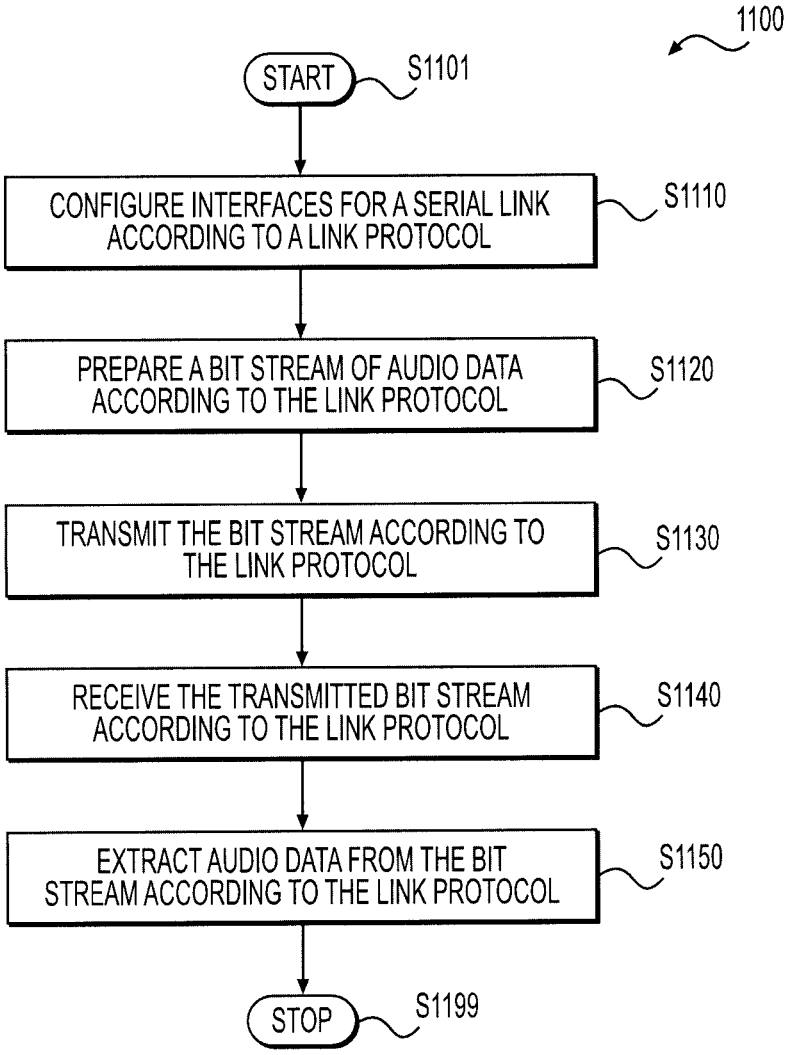
FIG. 11 shows a flow chat outlining a process example 1100 according to an embodiment of the disclosure.

FIG. 11 shows a flow chart outlining a process example 1100 according to an embodiment of the disclosure. The process can be executed in an audio system, such as the audio systems 100, 200 and 300. The audio system includes a transmitter, such as the first circuit 110, and a receiver, such as the second circuit 130. The process starts at S1101 and proceeds to S1110.

At S1110, interfaces of the audio system are configured according to one of a plurality of link protocols. In the FIG. 1 example, the first circuit 110 and the second circuit 130 are coupled together by a serial link for audio data transfer. The serial link includes a first conductive coupling for the frame clock (FCLK), a second conductive coupling for the bit clock (BCLK), and a third conductive coupling for serial data transfer (SDOUT-SDIN). In an example, the controller 121 and the controller 141 stores values corresponding to the link protocol. The controller 121 provides control signals to circuit components in the first interface 120 to configure the first interface 120 according to the link protocol. The controller 141 provides control signals to circuit components in the second interface 140 to configure the second interface 140 according to the link protocol.

At S1120, a bit stream of audio data is prepared according to the link protocol. In the FIG. 1 example, the audio data preparation circuit 123 is configured according to the link protocol, and thus the audio data preparation circuit 123 arranges audio data into bit streams according to the link protocol. In an example, the audio data preparation circuit 123 interleaves audio data units of different channels. In another example, the audio data preparation circuit 123 interleaves bits from different data units.

At S1130, the bit stream is transmitted by the transmitter of the audio system according to the link protocol. In the FIG. 1 example, the clock circuit 122 is configured according to the link protocol, and provides the frame clock and the bit clock according to the link protocol. In an example, the clock circuit 122 doubles the frequencies for the frame clock and the bit clock. In another example, the clock circuit 122 disables the bit clock for a time duration periodically. Further, the dual edge transmitting circuit 124 is configured according to the link protocol. The dual edge transmitting circuit 124 receives the bit stream, the frame clock and the bit clock and transmits the bit stream. In an example, the dual edge transmitting circuit 124 transmits in response to falling edges of the bit clock. In another example, the dual edge transmitting circuit 124 transmits in response to rising edges of the bit clock. In another example, the dual edge transmitting circuit 124 transmits in response to both falling edges and rising edges of the bit clock.

At 1140, the transmitted bit stream is received by the receiver of the audio system according to the link protocol. In the FIG. 1 example, the clock circuit 142 receives the frame clock and bit clock, and provides the frame clock and the bit clock to the dual edge receiving circuit 144. The dual edge receiving circuit 144 is configured according to the link protocol, and then operates based on the frame clock and the bit clock. In an example, the dual edge receiving circuit 144 samples the input in response to falling edges of the bit clock to receive the transmitted bit stream. In another example, the dual edge receiving circuit 144 samples the input in response to rising edges of the bit clock to receive the transmitted bit stream. In another example, the dual edge receiving circuit 144 samples the input in response to both falling edges and rising edges of the bit clock to receive the transmitted bit stream.

At S1150, audio data is extract from the bit stream according to the link protocol. In the FIG. 1 example, the audio data extraction circuit 143 is configured according to the link protocol, and extracts audio data from the bit stream according to the link protocol. Then the process proceeds to S1199 and stops.

It is noted that the steps in the process 1100 can be executed by different circuits that operate in parallel. For example, the dual edge transmitting circuit 124 and the dual edge receiving circuit 144 can operate in parallel. The dual edge transmitting circuit 124 transmits a bit stream bit-by-bit, and at the same time, the dual edge receiving circuit 144 operates to receive the bit stream bit-by-bit.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. An audio circuit, comprising:

a clock circuit configured to provide a clock signal for bit transmission and another clock signal for frame selection, the another clock signal being at a first voltage level or a second voltage level that is different from the first voltage level;

a transmitting circuit that is configurable to transmit bits of a bit stream from a first channel in response to a falling edge of the clock signal and transmit bits of the bit stream from a second channel in response to a rising edge of the clock signal while the another clock signal is at the first voltage level;

an audio data preparation circuit that is configurable to insert audio data into the bit stream and provide the bit stream to the transmitting circuit; and a controller configured to provide control signals to configure the transmitting circuit and the audio data preparation circuit according to a link protocol.

2. The audio circuit of claim 1, wherein the clock circuit is configured to generate the clock signal and output the clock signal to an external circuit.

3. The audio circuit of claim 2, wherein the clock circuit is configurable to double a frequency of the clock signal or to disable transitions in the clock signal for a time duration.

4. The audio circuit of claim 1, wherein the clock circuit is configured to receive the clock signal from an external circuit.

5. The audio circuit of claim 1, wherein the audio data preparation circuit is configured to interleave audio data to form the bit stream.

6. A method for audio data transmission, comprising:

configuring an audio data transmission interface according to a link protocol;

inserting audio data into a bit stream according to the link protocol; and transmitting bits of the bit stream from a first channel in response to a falling edge of a clock signal and transmitting bits of the bit stream from a second channel in response to a rising edge of the clock signal while another clock signal is at a first voltage level, the another clock signal being at the first voltage level or a second voltage level that is different from the first voltage level.

7. The method of claim 6, further comprising:

generating the clock signal according to the link protocol; and outputting the clock signal to an external circuit.

8. The method of claim 7, further comprising:

doubling a frequency of the clock signal according to the link protocol; or disabling transitions in the clock signal for a time duration according to the link protocol.

9. The method of claim 6, further comprising:

receiving the clock signal from an external circuit.

10. The method of claim 6, wherein inserting the audio data into the bit stream according to the link protocol further comprises:

interleaving audio data to form the bit stream.

11. An audio circuit, comprising:

a clock circuit configured to provide a clock signal for receiving a bit stream and another clock signal for frame selection, the another clock signal being at a first voltage level or a second voltage level that is different, from the first voltage level;

a receiving circuit that is configurable to sample an input to receive bits of the bit stream from a first channel in response to a falling edge of the clock signal and receive bits of the bit stream from a second channel in response to rising edge of the clock signal while the another clock signal is at the first voltage level:

an audio data extraction circuit that is configurable to extract audio data from the bit stream; and a controller configured to provide control signals to configure the receiving circuit and the audio data extraction circuit.

12. The audio circuit of claim 11, wherein the clock circuit is configured to generate the clock signal and output the clock signal to an external circuit.

13. The audio circuit of claim 12, wherein he clock circuit is configurable to double a frequency of the clock signal according to the link protocol or to disable transitions in the clock signal for a time duration according to the link protocol.

14. The audio circuit of claim 11, wherein the clock circuit is configured to receive the clock signal from an external circuit.

15. A method for receiving audio data, comprising:

configuring an audio data receiver interface according to a link protocol;

sampling an input to receive bits of a bit stream from a first channel in response to a falling edge of a clock signal and receive bits of the bit stream from a second channel in response to a rising edge of the clock signal while another clock signal is at a first voltage level, the another clock signal being at the first voltage level or a second voltage level that is different from the first voltage level; and extracting audio data from the bit stream according to the link protocol.

16. The method of claim 15, further comprising at least one of:

generating the clock signal according to the link protocol; and receiving the clock signal from an external circuit.

* * * * *